United States Patent [19]

Bielicki

[11] 4,219,127

[45] Aug. 26, 1980

[54] MAGNETICALLY RESPONSIVE TAB FOR ALUMINUM CONTAINERS

[75] Inventor: Lucian C. Bielicki, Ridgefield, Conn.

[73] Assignee: Muni Recovery Systems, Inc., White Plains, N.Y.

[21] Appl. No.: 69,898

[22] Filed: Aug. 27, 1979

[51] Int. Cl.[3] ..... B65D 41/32
[52] U.S. Cl. ..... 220/269
[58] Field of Search ..... 220/269, 1, 273, 85 CH, 220/230, 379

[56] References Cited

U.S. PATENT DOCUMENTS

| | | | |
|---|---|---|---|
| 4,061,243 | 12/1977 | Khoury | 220/270 X |
| 4,130,219 | 12/1978 | Mallorca | 220/270 |

*Primary Examiner*—George T. Hall
*Attorney, Agent, or Firm*—Gravely, Lieder & Woodruff

[57] ABSTRACT

Means for rendering a non-magnetic type of container, such as an all-aluminum can, recoverable for the recycling of the aluminum in which a magnetically responsive device is attached to a part of the container containing the least amount of aluminum, such as the tab which effects the opening function, whereby a maximum amount of the aluminum can may be recovered for reuse.

9 Claims, 4 Drawing Figures

MAGNETICALLY RESPONSIVE TAB FOR ALUMINUM CONTAINERS

BACKGROUND OF THE INVENTION

It is recognized that the manufacturers of containers have made serious efforts to design easy-open end walls wherein the tabs could be secured in a non-detachable manner without unduly restricting the access to the contents. There are many containers for dry as well as liquid substances which are now provided with easy-open end wall structures having tab operated opening panels of the detachable variety. There are also numerous containers of more recent availability in which the provision for opening the end wall is of a non-detachable character. This type of non-detachable opening provision is usually designed so that when used on beverage containers especially the opening provision will not interfere with consumption of the contents directly through the opening. Generally, easy-open containers are made of a suitable aluminum material because it is a material having a characteristic permitting relatively less resistance to the scored type opening provision, and because it requires considerably less energy consumption in the manufacture thereof. The problem has long been recognized that aluminum containers are resistant to attack, unlike tin or steel, and that purchasers are not particularly neat about disposing of the containers after use. However, aluminum containers if recoverable can generate a significant energy saving in permitting the material to be recycled rather than to start the manufacture of containers from the raw material.

SUMMARY OF THE INVENTION

This invention is directed to the provision of an aluminum easy-open container and end wall in which a magnetically responsive tab is provided to facilitate recovery of the aluminum container body and end wall.

The objects of the invention are to provide a magnetically responsive tab device for easy-open aluminum cans, or to construct the tab of a combination of magnetic and non-magnetic material arranged so the tab combination will be easily and completely torn away from the end wall in a recycling system and to assemble either of the foregoing tabs so as not be in contact with the contents of the can and thereby avoid possible contamination of the contents.

A presently preferred embodiment of the invention comprises an all-aluminum container having an aluminum end wall fastened to the body in the usual manner, an easy-open panel formed in the end wall and defined by a score line along which the panel may be severed from the rest of the end wall, and a magnetically sensitized tab attached to the exterior of the end wall by a bendable or break-away tongue or web for permitting the tab to be used to exert a force on the easy-open panel and displace it from the end wall.

The preferred tab may be formed of a principal element of aluminum and a secondary element of a magnetically responsive material carried by the principal element, and also have an attaching tongue or web for normally non-detachably assembling the tab and its magnetically responsive means to the end wall so as to have it remain with the body and end wall when the same is discarded.

BRIEF DESCRIPTION OF THE DRAWINGS

The accompanying drawings are intended to illustrate presently preferred embodiments of the invention, wherein.

DESCRIPTION OF THE PREFERRED EMBODIMENTS

Figure 1:
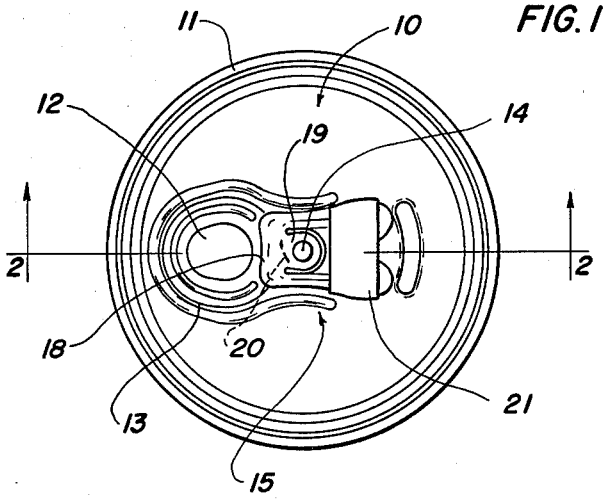
FIG. 1 is a top plan view of an easy-open container end wall provided with a typical scored panel and the improved magnetically responsive non-detachable tab for opening the panel.
Figure 2:
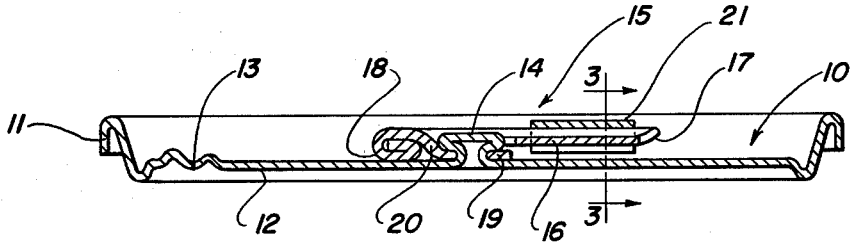
FIG. 2 is an enlarged sectional view taken along line 2—2 in FIG. 1 showing just the end wall and the attached tab.

Reference will now be made to FIG. 1 of the drawings wherein there is illustrated one typical easy-open end wall 10 for use in connection with containers having an all-aluminum body (not necessary to show). The end wall is formed of aluminum, and as shown in FIG. 2 is provided with a rim 11 which is suitably formed to be crimped or otherwise securely fastened to the cylindrical side wall of the container, all as is well known in the relevant art, such as Cudzik U.S. Pat. No. 3,967,753, issued July 6, 1976. The end wall is further provided with a panel 12 which may be displaced, relative to the wall 10, along a rupturable score line 13 which encircles the panel 12. The score line 13 has its beginning and ending in a zone adjacent a fastening element 14 which is an integral part of the end wall 10 as shown in FIG. 2.

The means for fracturing the panel 12 along the score line 13 is a tab 15 formed of a suitable aluminum, such as an aluminum alloy which has been heat treated in order to improve its rigidity or resistance to bending. The body of the tab is provided with a central panel 16 slightly recessed below marginal portions 17 which have been folded back in order to provide reinforced marginal ribs for increasing the stiffness. The stiffening ribs 17 extend into the nose portion 18 of the tab. The recessed portion of the tab 15 is further provided with a flap or tongue 19 integrally formed with the nose portion 18 of the tab. The tongue includes a rupturable hinge line 20 for the purpose of permitting the tab 15 to be bodily pivoted about the hinge 20 (in a counter clockwise direction as in FIG. 2) so as to force the nose 18 of the tab downwardly against the panel 12 for causing the panel to break free of the main portion of the end wall 10 along the score line 13. The tongue 19 of the tab for the easy-open end wall is easily slipped over the attachment 14 and then the attachment 14 is upset or headed so as to retain the tab in operative position.

Figure 3:
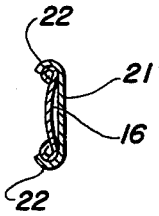
FIG. 3 is a sectional detail of the tab seen along line 3—3 in FIG. 2.

The tab 15, in accordance with the principal object of the present invention, is provided with magnetically responsive means 21 which is carried on the portion of the tab which acts as the prying handle for lifting the tab away from the end wall 10 to cause the tab nose 18 to perform its opening function. The magnetically responsive element 21 may be formed of ferrous material of suitable stiffness to permit its opposite margins 22 to be crimped around the sides of the tab 15 so as to effect desired retention of the element 21 during the normal handling from the time of closing of the container to the time of discarding the container after its contents have been dispensed or used up. As shown in FIG. 3 the magnetic element 21 is applied so as to extend over the recessed portion of the tab 15, but does not occupy a position that would interfere with the ability to apply a lifting force at the adjacent end of the tab. The magnetic element will not extend into or under rivet 14 so as to prevent any contamination of ferrous metal with aluminum when the aluminum can is shredded in a recycling operation. The aluminum rivet 14 will retain the severed portion of aluminum tab 19 thus enabling a simple magnetic separation of the magnetic tab.

Figure 4:
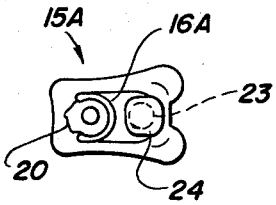
FIG. 4 is a fragmentary plan view of a modification of the tab.

A modification of a lifting tab 15A is shown in FIG. 4 wherein the recessed portion 16A if formed with an aperture 23 may be used for the reception of the shank of a magnetically responsive button or rivet 24. It should be understood that the shank of the rivet 24 which projects through the opening 23 is adapted to be upset on the underside so as to form a head for the purpose of retaining the button or rivet 24 in operative position throughout the life of the container or until the container is subjected to a suitable recycling procedure.

While the views of FIGS. 3 and 4 have been described in relation to metallic elements furnishing the magnetically sensitive means, it should be understood that magnetically responsive tape can be applied to the tab 15 or 15A, or other suitable magnetically responsive means, such as paint, may be carried by the tabs 15 or 15A. The object is to develop magnetic responsivity and not to unduly increase the cost of manufacture of the tabs per se.

The structure described above is directed to the provision of magnetically responsive means carried by the tab element of any of the aluminum easy-open container having an end wall composed of all-aluminum or non-magnetic material. Since the aluminum is a valuable metal and can, if recovered, form an important source of recyclable aluminum, it is significant to provide means for facilitating the recovery of the aluminum in the containers by systems which now are set up to process domestic and other waste materials for general disposal purposes. The presently disclosed embodiments are directed to simple and inexpensive means for making it possible to recover substantially all of aluminum containers having aluminum end walls, by providing the end wall of the container with magnetically responsive means, or forming the tab with a rupturable hinge so that in the recovery process suitable shredding apparatus may be utilized to reduce the containers and cause the tab 15 or 15A to become detached from the end wall, whereby that small portion may be magnetically separated from the non-magnetic aluminum. It is important to be able to extract the magnetic element so as not to contaminate the aluminum during its recycling process through suitable melting furnaces.

The foregoing description has made specific reference to structure for rendering an all-aluminum container subject to recover from municipal solid waste by the application of a magnetic field through the provision of a pliable aluminum tab hingedly connected to the container, and a magnetically responsive part carried by the aluminum tab and located so as to be attracted to an outside applied magnetic field. By constructing the aluminum tab with a magnetically responsive part, it is possible to bodily move the entire container into the magnetic field, thereby extracting such a container from a collection of trash and waste material for the express purpose of being able to recover the aluminum content in such containers.

While presently preferred embodiments of the invention have been illustrated and described above it should be recognized that this invention may be practiced by various other modifications, keeping in mind the process of permitting the aluminum to be recovered and recycled without being contaminated by the magnetically sensitive portion of the assembly.

What is claimed is:

1. In a container formed of recyclable aluminum in the body and end wall, and having a normally non-detachable aluminum tab device for effecting the opening of the container, the improvement which comprises magnetically responsive means applied to said tab device in position to achieve magnetic recovery of the container.

2. The improvement set forth in claim 1, wherein said magnetically responsive means is an element affixed to said tab, and said tab is connected to the container at a break-away hinge in such a manner as to permit total separation of tab from the aluminum can.

3. The improvement set forth in claim 1, wherein said magnetically responsive means is mechanically secured to the tab.

4. In an easy-open end wall for an aluminum container comprising: an openable non-magnetic end wall having a panel defined by a score line on the end wall; a panel opening aluminum tab mounted on the end wall adjacent said panel; a hinge element in said tab; means on the end wall connected to said tab hinge element for directing the opening movement of said tab against said panel; and a magnetically sensitive element carried by said aluminum tab.

5. The easy-open end wall of claim 4, wherein said hinge element provides a zone of weakness for permitting removal of said tab from the end wall.

6. The easy-open end wall of claim 4, wherein said magnetically sensitive element is formed of a ferrous material.

7. The easy-open end wall of claim 4, wherein said magnetically sensitive element is mechanically adhered to said tab.

8. The easy-open end wall of claim 4, wherein said magnetically sensitive element is removably attached to said tab.

9. A device for rendering an all-aluminum container recoverable by magnetism comprising: a pliable aluminum tab hingedly connected to the container; and a magnetically responsive part carried by said tab in position to be attracted to an outside applied magnetic field, whereby the entire container is bodily moved into the magnetic field.

* * * * *